US011384664B2

(12) United States Patent
Watanabe

(10) Patent No.: US 11,384,664 B2
(45) Date of Patent: Jul. 12, 2022

(54) VEHICLE OIL SUPPLY MECHANISM

(71) Applicant: TOYOTA JIDOSHA KABUSHIKI KAISHA, Toyota (JP)

(72) Inventor: Junji Watanabe, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 247 days.

(21) Appl. No.: 16/826,336

(22) Filed: Mar. 23, 2020

(65) Prior Publication Data

US 2020/0355100 A1 Nov. 12, 2020

(30) Foreign Application Priority Data

May 7, 2019 (JP) ..... JP2019-087892

(51) Int. Cl.
*F01M 11/00* (2006.01)

(52) U.S. Cl.
CPC ... *F01M 11/0004* (2013.01); *F01M 2011/007* (2013.01); *F01M 2011/0029* (2013.01)

(58) Field of Classification Search
CPC ..... F01M 11/0004; F01M 11/03; F01M 2011/0029; F01M 2011/007; F01M 2011/031
USPC ..... 184/6.24
See application file for complete search history.

(56) References Cited

U.S. PATENT DOCUMENTS 5,676,842 A * 10/1997 Bedi ..... F01M 11/0458 123/196 A

FOREIGN PATENT DOCUMENTS

| | | | |
|---|---|---|---|
| CN | 102345481 | A | 2/2021 |
| JP | 5-75414 | U | 10/1993 |
| JP | 2007-64125 | A | 3/2007 |
| JP | 2017-172721 | A | 9/2017 |

* cited by examiner

*Primary Examiner* — Lindsay M Low
*Assistant Examiner* — Omar Morales
(74) *Attorney, Agent, or Firm* — Oblon, McClelland, Maier & Neustadt, L.L.P.

(57) ABSTRACT

An air introduction hole having an aperture area smaller than that of an oil inlet is formed above the oil inlet, and therefore, when the oil level of oil accumulated in an oil pan inclines during traveling, air is sucked in through the air introduction hole, thereby restraining a decrease in hydraulic pressure of the oil. Further, the air introduction hole is formed behind the oil inlet in the vehicle front-rear direction in a vehicle. Accordingly, during heavy load traveling such as hill-climbing traveling, the air introduction hole sinks in the oil, thereby restraining the air from being sucked in through the air introduction hole. Accordingly, no air is sucked into an oil strainer, thereby making it possible to obtain high hydraulic pressure during heavy load traveling.

3 Claims, 3 Drawing Sheets

VEHICLE OIL SUPPLY MECHANISM

INCORPORATION BY REFERENCE

The disclosure of Japanese Patent Application No. 2019-087892 filed on May 7, 2019 including the specification, drawings and abstract is incorporated herein by reference in its entirety.

BACKGROUND

1. Technical Field

The present disclosure relates to a technology to reduce a decrease in hydraulic pressure due to air suction in a vehicle oil supply mechanism configured to pump up oil via an oil strainer, the oil being accumulated in an oil pan.

2. Description of Related Art

In terms of a vehicle oil supply mechanism configured to pump up oil via an oil strainer, the oil being accumulated in an oil pan, such a situation is conceivable. That is, when an oil level of the oil thus accumulated in the oil pan inclines during turning traveling or hill-climbing traveling, for example, an inlet of the oil strainer partially appears from the oil level. At this time, there is such a risk that hydraulic pressure of the oil decreases due to occurrence of air suction and mixing of a large amount of air into the oil. The air suction is a phenomenon that the air is sucked in through the inlet of the oil strainer. In terms of this, as described in Japanese Unexamined Utility Model Application Publication No. 5-75414 (JP 5-75414 U), for example, in a structure in which a plurality of oil transmission holes is formed in a peripheral wall of an oil suction filter formed in a cylindrical shape, when an oil level of oil accumulated in an oil pan inclines, the oil transmission holes gradually communicate with air. This restrains suction of a large amount of air, and thus, it is considered that a sudden decrease in hydraulic pressure can be restrained.

SUMMARY

However, in the case of the structure described in JP 5-75414 U, the oil transmission holes are formed over the entire oil suction filter. Accordingly, there is such a risk that air suction occurs under all traveling conditions in which an oil level of oil inclines, the traveling conditions including turning traveling, hill-climbing traveling, and so on. Here, at the time of heavy load traveling such as hill-climbing traveling, it is necessary to set hydraulic pressure of the oil to be high. However, in the structure described in JP 5-75414 U, when the air is gradually sucked into an oil strainer along with inclination of the oil level of the oil, there is such a risk that the oil does not increase to target hydraulic pressure and driving performance of the vehicle decreases.

The present disclosure has been achieved in view of the above circumstances as a background, and an object of the present disclosure is to provide a structure that can reduce a decrease in hydraulic pressure of oil due to air suction in an oil strainer at the time of heavy load traveling in terms of a vehicle oil supply mechanism including an oil pan in which the oil is accumulated, and the oil strainer.

A first aspect of the present disclosure relates to a vehicle oil supply mechanism including an oil pan and an oil strainer. In the oil pan, oil is accumulated. The oil strainer is provided inside the oil pan. The oil strainer includes an inlet through which the oil is sucked in, and an air introduction hole having an aperture area smaller than that of the inlet. In an in-vehicle state, the air introduction hole is formed above the inlet in the vertical direction and is formed behind the inlet in the vehicle front-rear direction.

Further, a second aspect of the present disclosure is as follows. That is, in the vehicle oil supply mechanism of the first aspect, in the in-vehicle state, the air introduction hole may be formed within a range where the inlet is formed in the vehicle width direction.

Further, a third aspect of the present disclosure is as follows. That is, in the vehicle oil supply mechanism of the second aspect, in the in-vehicle state, an upper part of the air introduction hole in the vertical direction may be inclined vertically upward toward the center of the air introduction hole in the vehicle width direction.

In the vehicle oil supply mechanism according to the first aspect, the air introduction hole having an aperture area smaller than that of the inlet is formed above the inlet in the vertical direction. Accordingly, when the oil level of the oil accumulated in the oil pan inclines during traveling, the air is sucked in through the air introduction hole before the air is sucked in through the inlet. Here, the aperture area of the air introduction hole is smaller than that of the inlet. Accordingly, an amount of the air to be sucked in through the air introduction hole is small as compared to a case where the air is sucked in through the inlet. Further, since the air is sucked in through the air introduction hole, a decrease in the oil level of the oil is restrained. This accordingly restrains suction of the air through the inlet. Hereby, in comparison with a case where the air is sucked in through the inlet, the amount of the air to be sucked into the oil strainer is reduced. This can reduce a decrease in hydraulic pressure of the oil. Further, during heavy load traveling such as hill-climbing traveling or acceleration traveling, the oil moves rearward in the vehicle front-rear direction. However, since the air introduction hole is formed behind the inlet in the vehicle front-rear direction in a vehicle, the air introduction hole sinks in the oil, thereby restraining the air from being sucked in through the air introduction hole. Accordingly, no air is sucked into the oil strainer, thereby making it possible to obtain high hydraulic pressure during heavy load traveling.

Further, in the vehicle oil supply mechanism according to the second aspect, the oil level of the oil inclines to right or left during turning traveling of the vehicle. However, since the air introduction hole is formed within the range where the inlet is placed in the vehicle width direction of the vehicle, the air is sucked in through the air introduction hole prior to the inlet during turning traveling. Hereby, during turning traveling, the air is sucked in through the air introduction hole. This accordingly restrains suction of the air through the inlet. Accordingly, in comparison with a case where the air is sucked in through the inlet, it is possible to reduce a decrease in hydraulic pressure of the oil.

Further, in the vehicle oil supply mechanism according to the third aspect, in the in-vehicle state, the air introduction hole is inclined vertically upward toward the center of the air introduction hole in the vehicle width direction of the vehicle. Accordingly, even during turning traveling, the air is hardly sucked in through the air introduction hole at the time when the oil level of the oil inclines due to the turning traveling. Accordingly, even during turning traveling, the air is not sucked in through the air introduction hole under a predetermined traveling condition, thereby making it possible to restrain a decrease in hydraulic pressure of the oil due to suction of the air through the air introduction hole.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

An embodiment of the present disclosure will hereinafter be described in detail with reference to the attached drawings. Note that the drawings are simplified or deformed appropriately in the following embodiment, and a scale ratio, a shape, and so on of each part are not necessarily drawn precisely.

Embodiment

Figure 1:
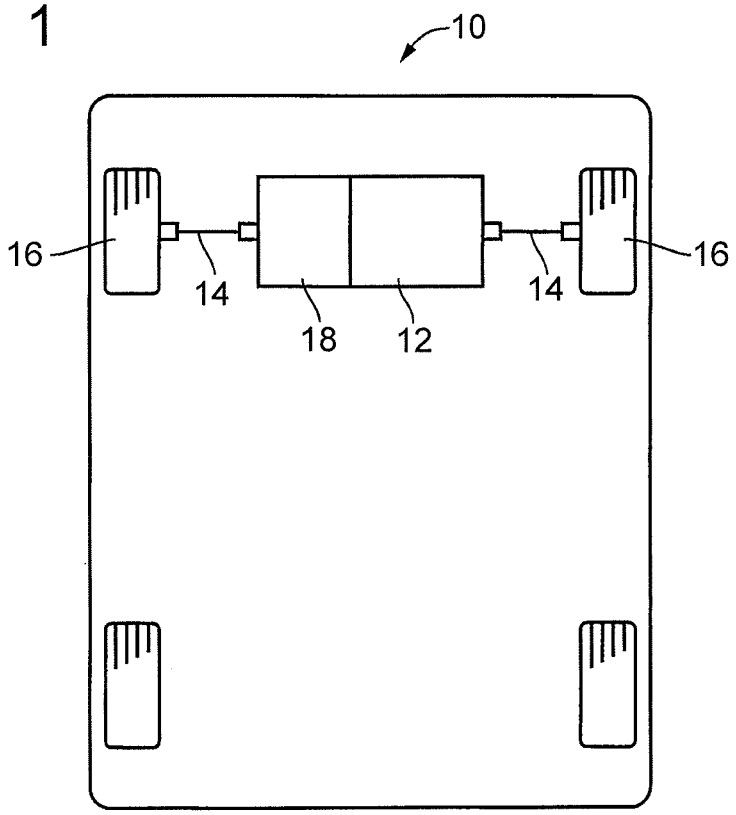
FIG. 1 is a schematic view of a vehicle to which the present disclosure is applied.

FIG. 1 is a schematic view of a vehicle 10 to which the present disclosure is applied. The vehicle 10 includes an engine 12 as a driving force source, and a transaxle 18 configured to transmit power of the engine 12 to front wheels 16 via a pair of right and left axles 14. The vehicle 10 is a vehicle of an FF type (front-engine, front-wheel drive type) in which the engine 12 and the transaxle 18 are arranged laterally on the front side of the vehicle.

Figure 2:
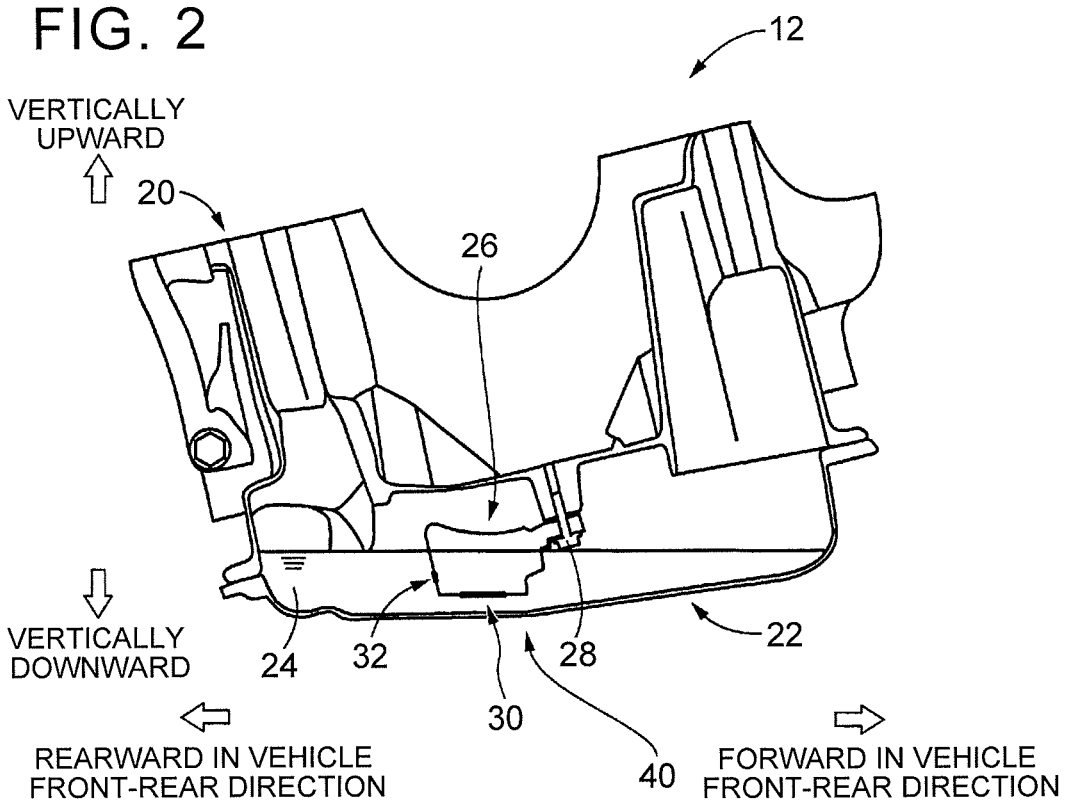
FIG. 2 illustrates an engine block constituting an engine in FIG. 1 and a state inside an oil pan connected to a lower part of the engine block.

FIG. 2 illustrates an engine block 20 constituting the engine 12 in FIG. 1 and a state inside an oil pan 22 connected to a lower part of the engine block 20. FIG. 2 corresponds to a state (posture) of the engine block 20 and the oil pan 22 when the vehicle 10 is viewed from its right side. In FIG. 2, the upper side on the plane of paper corresponds to a vertically upper side, and the lower side on the plane of paper corresponds to a vertically lower side. Further, the right side on the plane of paper corresponds to the front side in the vehicle front-rear direction, and the left side on the plane of paper corresponds to the rear side in the vehicle front-rear direction. Note that FIG. 2 illustrates a traveling state where the vehicle 10 is on a flat road surface, and no acceleration or deceleration is performed on the vehicle 10.

As illustrated in FIG. 2, the oil pan 22 is connected to the lower part of the engine block 20 by bolts (not shown). The oil pan 22 is a member having a sagging shape and constituted by an iron plate member having a predetermined thickness. A predetermined amount of engine oil 24 (hereinafter referred to as the oil 24) is accumulated in the oil pan 22, and the oil 24 is sucked up by an oil pump (not shown) and is supplied to each part of the engine 12.

An oil strainer 26 is provided in a space of the oil pan 22 in which the oil 24 is accumulated. The oil strainer 26 is fixed to the engine block 20 by a bolt 28. The oil strainer 26 is configured to remove foreign matter mixed in the oil 24 by use of a filter provided inside the oil strainer 26 when the oil 24 accumulated in the oil pan 22 is sucked up by an oil pump (not shown) driven by the engine 12. A vehicle oil supply mechanism 40 configured to supply the oil 24 to each part of the engine 12 includes the oil pan 22 and the oil strainer 26.

In an in-vehicle state illustrated in FIG. 2, an oil inlet 30 via which the oil 24 is sucked in is formed in a lower part of the oil strainer 26 in the vertical direction. The oil inlet 30 is formed at a position of the lower part of the oil strainer 26 in the vertical direction so that the oil inlet 30 sinks in the oil 24 in a traveling state where no acceleration or deceleration is performed on a flat road surface. Note that the oil inlet 30 corresponds to an inlet in the present disclosure.

In the meantime, in the oil strainer 26, when a rotation speed of the engine 12 becomes high during hill-climbing traveling, for example, the amount of the oil 24 sucked up by the oil pump increases, so that the height of an oil level of the oil 24 in the oil pan 22 is lowered. Further, when the oil level of the oil 24 inclines due to a gradient of the road surface, the oil inlet 30 partially appears from the oil level. This might cause such a risk that air suction occurs and a sudden decrease in hydraulic pressure occurs. The air suction is a phenomenon that a large amount of air is sucked into the oil strainer 26. In order to prevent the air suction from the oil inlet 30, it is conceivable to increase the oil amount of the oil 24 or to increase the depth of the oil pan 22. However, this results in that the weight of the vehicle increases or the engine 12 is arranged at a high position, thereby causing a deterioration in fuel efficiency and a decrease in driving performance.

In order to solve such a problem, the oil strainer 26 has an air introduction hole 32 via which the air is sucked in prior to the oil inlet 30. The air introduction hole 32 is a communication hole via which an external space of the oil strainer 26 communicates with an internal space of the oil strainer 26. The air introduction hole 32 is formed at a position behind the oil inlet 30 in the vehicle front-rear direction in the vehicle 10. Further, the air introduction hole 32 sinks in the oil 24 in a traveling state where no acceleration or deceleration is performed as illustrated in FIG. 2. Accordingly, in the state illustrated in FIG. 2, the air is not sucked in through the air introduction hole 32.

Figure 3:
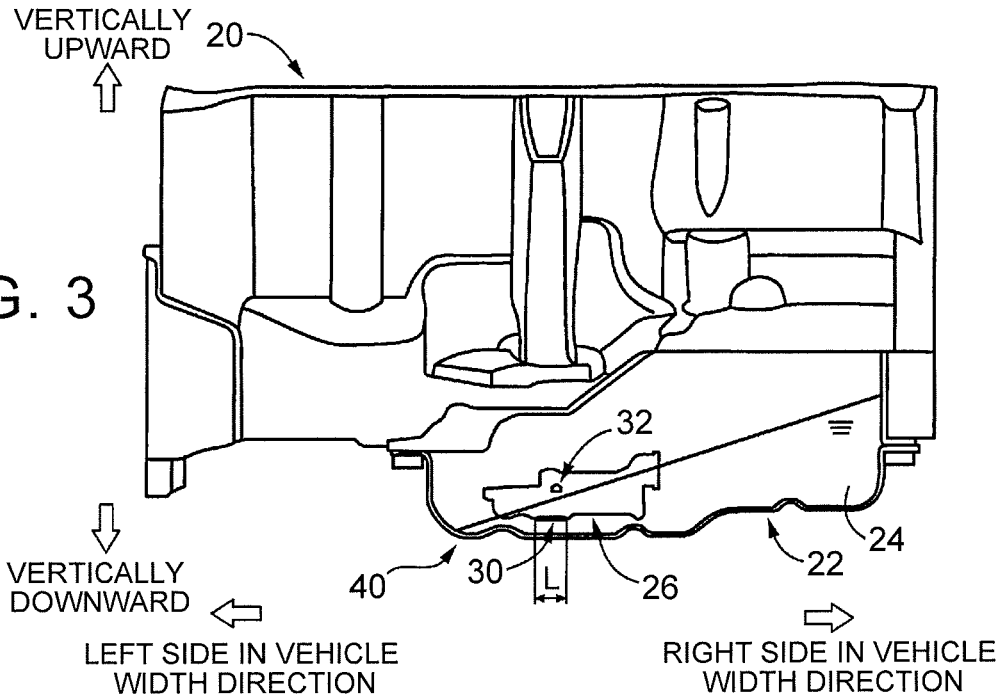
FIG. 3 illustrates a state inside the oil pan during counterclockwise turning traveling.

FIG. 3 illustrates a state inside the oil pan 22 during counterclockwise turning traveling. FIG. 3 corresponds to a view when the oil pan 22 is viewed from the rear side of the vehicle 10 in an in-vehicle state. In FIG. 3, the right side on the plane of paper corresponds to the right side of the vehicle 10, and the left side on the plane of paper corresponds to the left side of the vehicle 10. Further, in FIG. 3, the upper side on the plane of paper corresponds to the upper side in the vertical direction, and the lower side on the plane of paper corresponds to the lower side in the vertical direction.

In FIG. 3, the oil inlet 30 is formed in a vertically lower part of the oil strainer 26 and at a position within a range L in a direction of a vehicle width (hereinafter referred to as the vehicle width direction) of the vehicle 10. Further, the air introduction hole 32 is formed in a wall placed on the rear side of the oil strainer 26 in the vehicle front-rear direction. The air introduction hole 32 is formed above the oil inlet 30 in the vertical direction. That is, the air introduction hole 32 is formed within the range L where the oil inlet 30 is placed in the vehicle width direction of the vehicle 10. Accordingly, when the oil level of the oil 24 inclines during turning traveling of the vehicle, the air introduction hole 32 appears from the oil level of the oil 24 prior to the oil inlet 30. As a result, the air is sucked in through the air introduction hole 32 prior to the oil inlet 30.

For example, during counterclockwise turning traveling, as illustrated in FIG. 3, the oil 24 accumulated in the oil pan 22 deviates to the right side in the vehicle width direction. Accordingly, the height of the oil level of the oil from the bottom of the oil pan 22 becomes lower toward the left side in the vehicle width direction. At this time, as illustrated in FIG. 3, the air introduction hole 32 appears from the oil level of the oil 24, so that the air is sucked in through the air introduction hole 32.

Figure 4:
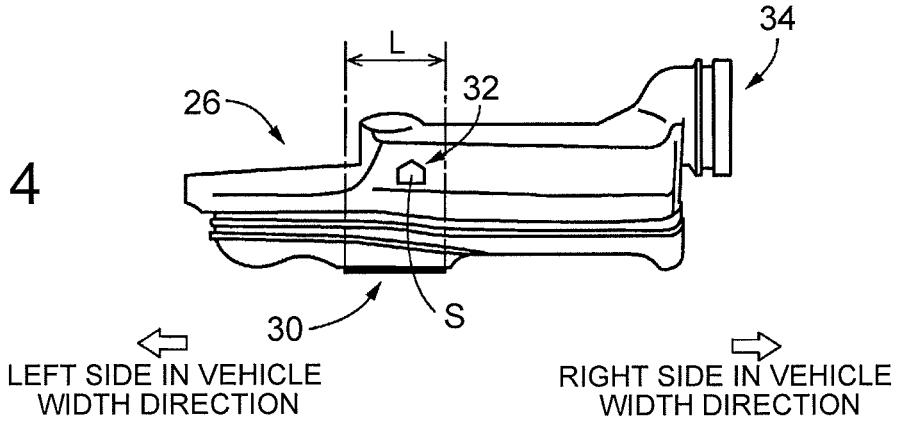
FIG. 4 is an enlarged view of an oil strainer in FIG. 3.

FIG. 4 is an enlarged view of the oil strainer 26 in FIG. 3. A connecting portion 34 connected to the oil pump (not shown) is provided on the right side of the oil strainer 26 in the vehicle width direction. The oil inlet 30 is formed in the vertically lower part of the oil strainer 26. The air introduction hole 32 is formed in a pentagonal shape. Further, the air introduction hole 32 is formed within the range L where the oil inlet 30 is formed in the vehicle width direction.

Here, an aperture area S of the air introduction hole 32 is smaller than an aperture area of the oil inlet 30. The aperture area of the oil inlet 30 corresponds to an area of a part of the oil inlet 30 through which the oil 24 is sucked in, namely, an area when the oil strainer 26 is viewed from the vertically lower part in an in-vehicle state. Further, the aperture area S of the air introduction hole 32 corresponds to an area of the pentagonal shape forming the air introduction hole 32 illustrated in FIG. 4.

The aperture area S of the air introduction hole 32 is made smaller than the aperture area of the oil inlet 30. Accordingly, an amount of the air to be sucked in through the air introduction hole 32 at the time when the air introduction hole 32 appears from the oil level of the oil 24 during turning traveling is small in comparison with a case where the air is sucked in through the oil inlet 30. When a small amount of the air is sucked into the oil strainer 26 through the air introduction hole 32 during turning traveling as such, the amount of the air to be sucked into the oil strainer 26 is reduced. Also, when the air is sucked into the oil strainer 26 through the air introduction hole 32, a decrease in hydraulic pressure of the oil 24 is relaxed, thereby restraining a sudden decrease in hydraulic pressure of the oil 24. Further, when the air is sucked into the oil strainer 26 through the air introduction hole 32, a suction amount of the oil 24 by the oil pump decreases, so that a decrease in the oil level of the oil 24 is also relaxed. This accordingly restrains the oil inlet 30 from appearing from the oil level of the oil, thereby restraining suction of the air through the oil inlet 30.

Further, in the in-vehicle state, an upper part of the air introduction hole 32 in the vertical direction is inclined vertically upward toward the center of the air introduction hole 32 in the vehicle width direction of the vehicle 10. More specifically, an inclined portion 36 (see FIG. 5) is formed in the upper part of the air introduction hole 32 in the vertical direction. The inclined portion 36 inclines upward as it goes toward the right side in the vehicle width direction from a left end portion of the air introduction hole 32 in the vehicle width direction. Further, an inclined portion 38 (see FIG. 5) is formed in the upper part of the air introduction hole 32 in the vertical direction. The inclined portion 38 inclines upward as it goes toward the left side in the vehicle width direction from a right end portion of the air introduction hole 32 in the vehicle width direction. In the vicinity of the center of the air introduction hole 32 in the vehicle width direction, the inclined portions 36, 38 are connected to each other. Hereby, a central part of the air introduction hole 32 in the vehicle width direction projects upward in the vertical direction.

Figure 5:
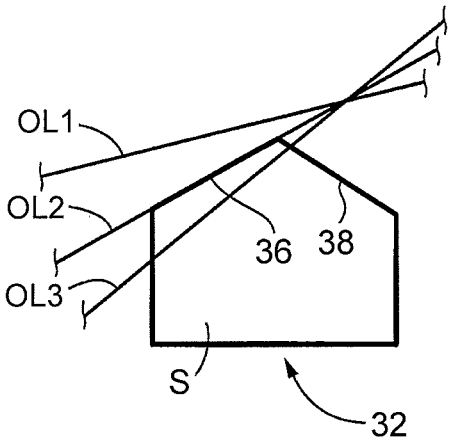
FIG. 5 is an enlarged view of an air introduction hole in FIG. 4.

Respective inclinations of the inclined portion 36 and the inclined portion 38 that are formed in the upper part of the air introduction hole 32 in the vertical direction are formed to match the inclination of the oil level of the oil 24 during turning traveling of the vehicle. FIG. 5 is an enlarged view of the air introduction hole 32 in FIG. 4. In FIG. 5, OL1 to OL3 indicate oil levels of the oil 24 in different traveling states during counterclockwise turning traveling.

For example, during counterclockwise turning traveling, in a state of the oil level OL1 of the oil 24, the whole air introduction hole 32 sinks in the oil 24. At this time, the air is not sucked in through the air introduction hole 32. In the meantime, when the oil level of the oil 24 further inclines and the oil 24 reaches the oil level OL2, the oil level of the oil 24 is along the inclined portion 36 of the air introduction hole 32. When the oil level of the oil 24 still further inclines and the oil 24 reaches the oil level OL3, the air introduction hole 32 partially becomes higher than the position of the oil level of the oil 24. At this time, the air is sucked in through a part of the air introduction hole 32, the part being placed above the oil level of the oil 24.

Even during turning traveling of the vehicle, it is desired that no air be sucked in through the air introduction hole 32. In this respect, as the vertically upper part of the air introduction hole 32 is inclined, even during counterclockwise turning traveling, no air is sucked in through the air introduction hole 32 until the oil 24 reaches the oil level OL2. Since the vertically upper part of the air introduction hole 32 is inclined as such, no air is sucked in through the air introduction hole 32 until the inclination of the oil level of the oil reaches the oil level OL2 even during counterclockwise turning traveling. Accordingly, the air is hardly sucked in through the air introduction hole 32 even during counterclockwise turning traveling. Note that, FIG. 5 illustrates an aspect during counterclockwise turning traveling. However, since the inclined portion 38 is formed, the air is also hardly sucked in through the air introduction hole 32 during clockwise turning traveling. Further, the positions where the inclined portions 36, 38 of the air introduction hole 32 are formed, respective inclinations (shapes) of the inclined portions 36, 38, and so on are set in advance through experiment or the like. The positions, the inclinations, and so on of the inclined portions 36, 38 are set such that the air introduction hole 32 sinks in the oil until the inclination of the oil level of the oil exceeds a predetermined value in case of quick turning traveling or the like.

Figure 6:
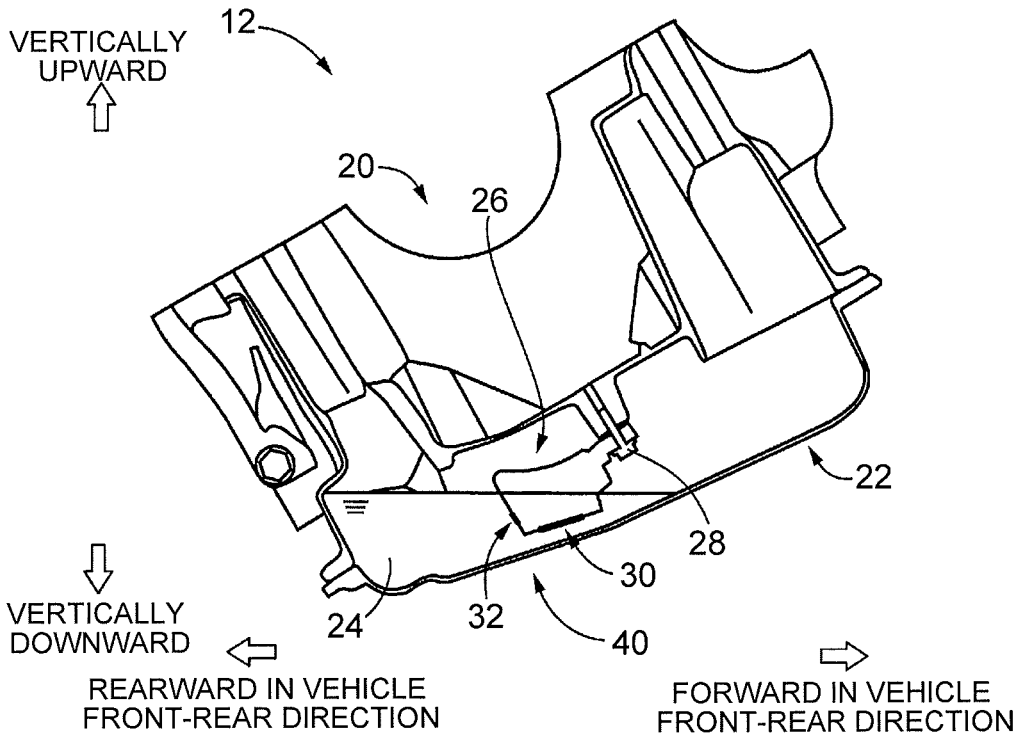
FIG. 6 is a view illustrating a state inside the oil pan during hill-climbing traveling.

FIG. 6 illustrates a state inside the oil pan 22 during hill-climbing traveling. Similarly to FIG. 2, FIG. 6 corresponds to a state when the vehicle 10 is viewed from the right side in the in-vehicle state. In FIG. 6, the right side on the plane of paper corresponds to the front side in the vehicle front-rear direction, the left side on the plane of paper corresponds to the rear side in the vehicle front-rear direction, the upper side on the plane of paper corresponds to the upper side in the vertical direction, and the lower side on the plane of paper corresponds to the lower side in the vertical direction. As illustrated in FIG. 6, during hill-climbing traveling, the engine block 20 and the oil pan 22 incline in accordance with the gradient of the road surface as compared with those in FIG. 2. At this time, the oil 24 deviates to the rear side in the vehicle front-rear direction, so that the height of the oil level from the bottom of the oil pan 22 becomes higher toward the rear side in the vehicle front-rear direction. Accordingly, the air introduction hole 32 placed on the rear side of the oil strainer 26 in the vehicle front-rear direction in the vehicle 10 sinks in the oil 24. From this point, during hill-climbing traveling, the air introduction hole 32 sinks in the oil, so that no air is sucked into the oil strainer 26 through the air introduction hole 32.

During hill-climbing traveling, a load applied to the engine 12 is large, and therefore, it is preferable that hydraulic pressure of the oil 24 pumped up by the oil pump do not decrease. In this respect, during hill-climbing traveling, the air introduction hole 32 sinks in the oil as illustrated in FIG. 6. As a result, no air is sucked in through the air introduction hole 32, so that a decrease in hydraulic pressure of the oil 24 is restrained.

Further, during acceleration traveling of the vehicle 10, a relative position between the position of the oil level of the oil 24 and the oil strainer 26 is generally the same as that in FIG. 6. That is, the oil 24 moves rearward in the vehicle front-rear direction as the vehicle 10 is accelerated. Accordingly, also during acceleration traveling, the air introduction hole 32 formed in the oil strainer 26 sinks in the oil as illustrated in FIG. 6. During acceleration traveling, a load applied to the engine 12 is large, and therefore, it is preferable that hydraulic pressure of the oil 24 pumped up by the oil pump do not decrease. In this respect, during acceleration traveling, the air introduction hole 32 sinks in the oil. As a result, no air is sucked in through the air introduction hole 32, so that a decrease in hydraulic pressure of the oil 24 is restrained.

As described above, in the present embodiment, the air introduction hole 32 having an aperture area smaller than that of the oil inlet 30 is formed above the oil inlet 30 in the vertical direction. Accordingly, when the oil level of the oil 24 accumulated in the oil pan 22 inclines during traveling, the air is sucked in through the air introduction hole 32 before the air is sucked in through the oil inlet 30. Here, the aperture area of the air introduction hole 32 is smaller than that of the oil inlet 30. Accordingly, the amount of the air to be sucked in through the air introduction hole 32 is small as compared to a case where the air is sucked in through the oil inlet 30. Further, since the air is sucked in through the air introduction hole 32, a decrease in the oil level of the oil 24 is restrained. This accordingly restrains suction of the air through the oil inlet 30. Hereby, in comparison with a case where the air is sucked in through the oil inlet 30, the amount of the air sucked into the oil strainer 26 is reduced. This can reduce a decrease in hydraulic pressure of the oil 24.

Further, during heavy load traveling such as hill-climbing traveling or acceleration traveling, the oil 24 moves rearward in the vehicle front-rear direction. However, since the air introduction hole 32 is formed behind the oil inlet 30 in the vehicle front-rear direction in the vehicle 10, the air introduction hole 32 sinks in the oil 24, thereby restraining the air from being sucked in through the air introduction hole 32. Accordingly, no air is sucked into the oil strainer 26, thereby making it possible to obtain high hydraulic pressure during heavy load traveling. In this respect, since it is not necessary to increase an oil amount of the oil 24, deterioration in fuel efficiency is restrained. Further, warming-up performance also improves because the oil amount of the oil 24 does not increase. Further, as it is not necessary to increase the depth of the oil pan 22, it is not necessary to set an arrangement position of the engine 12 to be high. As a result, it is possible to restrain a decrease in driving performance.

Further, according to the present embodiment, the oil level of the oil 24 inclines to right or left during turning traveling of the vehicle 10. However, since the air introduction hole 32 is formed within the range where the oil inlet 30 is placed in the vehicle width direction of the vehicle 10, the air is sucked in through the air introduction hole 32 prior to the oil inlet 30 during turning traveling. Hereby, during turning traveling, the air is sucked in through the air introduction hole 32. This accordingly restrains suction of the air through the oil inlet 30. Accordingly, in comparison with a case where the air is sucked in through the oil inlet 30, it is possible to reduce a decrease in hydraulic pressure of the oil 24. Further, in the in-vehicle state, the air introduction hole 32 is inclined vertically upward toward the center of the air introduction hole 32 in the vehicle width direction of the vehicle 10. Accordingly, even during turning traveling, the air is hardly sucked in through the air introduction hole 32 at the time when the oil level of the oil 24 inclines due to the turning traveling. Accordingly, even during turning traveling, the air is not sucked in through the air introduction hole 32 under a predetermined traveling condition. This restrains a decrease in hydraulic pressure of the oil due to suction of the air through the air introduction hole 32.

The embodiment of the present disclosure has been described in detail with reference to the drawings, but the present disclosure is also applied to other aspects.

For example, in the above embodiment, the air introduction hole 32 is formed in the oil strainer 26 arranged inside the engine 12 that is an internal combustion engine. However, the present disclosure is not necessarily limited to the engine 12. For example, an air introduction hole may be formed in an oil strainer arranged inside a transmission. In short, the present disclosure can be applied appropriately to a configuration including an oil strainer provided inside an oil pan in a vehicle.

Further, in the above embodiment, the air introduction hole 32 is formed in a pentagonal shape. However, the air introduction hole 32 is not necessarily limited to the pentagonal shape. For example, the air introduction hole may be formed in a triangular shape. Further, an upper end of the air introduction hole 32 in the vertical direction has a pointed shape. However, the upper end of the air introduction hole 32 does not necessarily have a pointed shape. The upper end portion of the air introduction hole may be formed in parallel to the vehicle width direction.

Further, in the above embodiment, the vehicle 10 is an FF-type vehicle that uses the engine 12 as a driving source. However, the present disclosure is not necessarily limited to the above aspect. For example, the present disclosure is also applicable to a hybrid vehicle. In short, the present disclosure is applicable appropriately to a vehicle including a vehicle oil supply mechanism configured to suck up oil via an oil strainer, the oil being accumulated in an oil pan.

Note that the above descriptions are merely one embodiment to the utmost, and the present disclosure can be performed in an embodiment to which various changes and improvements are added based on the knowledge of a person skilled in the art.

What is claimed is:

1. A vehicle oil supply mechanism comprising:

an oil pan in which oil is accumulated; and an oil strainer provided inside the oil pan, wherein:

the oil strainer includes an inlet through which the oil is sucked in, and an air introduction hole having an aperture area smaller than that of the inlet, the air introduction hole being an opening that extends from the inside of the oil pan to an internal space of the oil strainer; and in an in-vehicle state, the air introduction hole is formed above the inlet in a vertical direction and is formed behind the inlet in a vehicle front-rear direction.

2. The vehicle oil supply mechanism according to claim 1, wherein, in the in-vehicle state, the air introduction hole is formed within a range where the inlet is formed in a vehicle width direction.

3. The vehicle oil supply mechanism according to claim 2, wherein, in the in-vehicle state, an upper part of the air introduction hole in the vertical direction is inclined vertically upward toward a center of the air introduction hole in the vehicle width direction.

* * * * *